US007008340B2

(12) United States Patent
Williams et al.

(10) Patent No.: US 7,008,340 B2
(45) Date of Patent: Mar. 7, 2006

(54) RAM-TYPE TENSIONER ASSEMBLY HAVING INTEGRAL HYDRAULIC FLUID ACCUMULATOR

(75) Inventors: Richard D. Williams, Sugar Land, TX (US); Lacey C. Coffey, Houston, TX (US)

(73) Assignee: Control Flow Inc., Houston, TX (US)

( * ) Notice: Subject to any disclaimer, the term of this patent is extended or adjusted under 35 U.S.C. 154(b) by 238 days.

(21) Appl. No.: 10/314,710

(22) Filed: Dec. 9, 2002

(65) Prior Publication Data

US 2004/0110589 A1 Jun. 10, 2004

(51) Int. Cl.
*F16H 7/08* (2006.01)
*F16H 7/18* (2006.01)
*F21B 29/12* (2006.01)

(52) U.S. Cl. ..... 474/101; 474/110; 166/355; 405/224.4

(58) Field of Classification Search ..... 474/101, 474/110, 109; 175/5, 7, 8; 91/4 R, 4 A; 166/355, 350, 346, 367; 405/224.3, 224.2, 405/224.4
See application file for complete search history.

(56) References Cited

U.S. PATENT DOCUMENTS

| | | | | |
|---|---|---|---|---|
| 913,970 A | | 3/1909 | Parfitt | |
| 1,815,907 A | * | 7/1931 | Halstead et al. | 91/4 R |
| 3,208,728 A | | 9/1965 | Parks | |
| 3,280,908 A | | 10/1966 | Todd | |
| 3,313,345 A | | 4/1967 | Fischer | |
| 3,643,751 A | | 2/1972 | Crickmer | |
| 3,680,644 A | | 8/1972 | Doughty | |
| 3,718,316 A | | 2/1973 | Larralde et al. | |
| 3,793,835 A | | 2/1974 | Larralde | |
| 3,804,183 A | | 4/1974 | Duncan et al. | |
| 3,841,607 A | | 10/1974 | Larralde et al. | |
| 3,897,045 A | | 7/1975 | Butler | |
| 3,912,227 A | * | 10/1975 | Meeker et al. | 175/5 |
| 3,955,621 A | | 5/1976 | Webb | |
| 4,004,532 A | | 1/1977 | Reynolds | |
| 4,068,868 A | | 1/1978 | Ohrt | |
| 4,075,858 A | | 2/1978 | Frederick | |
| 4,176,722 A | | 12/1979 | Wetmore et al. | |
| 4,215,950 A | | 8/1980 | Stevenson | |
| 4,222,341 A | | 9/1980 | Larsen et al. | |
| 4,272,059 A | | 6/1981 | Noerager et al. | |
| 4,317,586 A | | 3/1982 | Campbell | |

(Continued)

FOREIGN PATENT DOCUMENTS

FR 2484352 A1 * 12/1981

(Continued)

*Primary Examiner*—Marcus Charles
(74) *Attorney, Agent, or Firm*—Andrews Kurth LLP; Anthony F. Matheny

(57) ABSTRACT

The invention is directed to a tensioner assembly for providing tensile force from a floating vessel at the surface of the ocean to the blowout preventer stack, or production tree, which is connected to the wellhead at the sea floor. The tensioner assembly compensates for vessel motion induced by wave action and heave and maintains a variable tension to the riser string alleviating the potential for compression and thus buckling or failure of the riser string. The tensioner assembly of the present invention includes a cylinder, a stop tube disposed with the cylinder, and a ram slidably engaged within the stop tube. The tensioner assembly also includes at least one gas, or air, transfer tube to create a pressurized air over hydraulic fluid arrangement to provide tensile force to the tensioner assembly.

6 Claims, 4 Drawing Sheets

U.S. PATENT DOCUMENTS 4,362,438 A 12/1982 Spink
4,367,981 A 1/1983 Shapiro
4,379,657 A 4/1983 Widiner et al.
4,421,173 A 12/1983 Beakley et al.
4,423,983 A 1/1984 Dadiras et al.
4,432,420 A 2/1984 Gregory et al.
4,449,854 A 5/1984 Nayler
4,473,323 A 9/1984 Gregory
4,479,550 A 10/1984 Kühn et al.
4,487,150 A 12/1984 Shanks
4,501,219 A 2/1985 Bates, Jr.
4,615,542 A 10/1986 Ideno et al.
4,638,978 A 1/1987 Jordan
4,712,620 A 12/1987 Lim et al.
4,787,778 A 11/1988 Myers et al.
4,799,827 A 1/1989 Jaqua
4,808,035 A 2/1989 Stanton et al.
4,828,536 A * 5/1989 Ampferer ..... 474/110
4,883,387 A 11/1989 Myers et al.
4,884,642 A 12/1989 Fadeev et al.
4,886,397 A 12/1989 Cherbonnier
5,101,905 A 4/1992 Arlt et al.
5,117,786 A * 6/1992 Trzmiel et al. ..... 474/110
5,169,265 A 12/1992 Butler et al.
5,183,121 A 2/1993 Koudelka
5,209,302 A 5/1993 Robichaux et al.
5,252,004 A 10/1993 Butler et al.
5,551,803 A 9/1996 Pallini, Jr. et al.
5,658,095 A 8/1997 Arlt et al.
5,667,022 A 9/1997 Güde
5,727,630 A 3/1998 Brammer
5,758,990 A 6/1998 Davies et al.
5,846,028 A 12/1998 Thory
5,951,061 A 9/1999 Arlt, III et al.
5,960,893 A 10/1999 Prokop et al.
6,073,706 A 6/2000 Niemi
6,170,317 B1 1/2001 Juuri et al.
6,296,232 B1 10/2001 Roodenburg
6,343,662 B1 2/2002 Byrt et al.
6,343,893 B1 2/2002 Gleditsch
6,419,277 B1 7/2002 Reynolds
6,431,284 B1 8/2002 Finn et al.
6,691,784 B1 * 2/2004 Wanvik ..... 405/224.4
2002/0040798 A1 4/2002 Intonen et al.

FOREIGN PATENT DOCUMENTS

GB 2141470 A 12/1984
WO WO 97/43516 11/1997
WO WO 00/24998 5/2000

* cited by examiner

RAM-TYPE TENSIONER ASSEMBLY HAVING INTEGRAL HYDRAULIC FLUID ACCUMULATOR

BACKGROUND OF THE INVENTION

1. Field of the Invention

The invention relates to tensioning devices for exerting a tensile force from a drilling vessel or drilling platform upon a drilling or production riser.

2. Description of Related Art

A marine riser system is employed to provide a conduit from a floating vessel at the water surface to the blowout preventer stack or, production tree, which is connected to the wellhead at the sea floor. A tensioner, or motion compensator, is incorporated into the riser string to compensate for vessel motion induced by wave action and heave. A tensioning system is utilized to maintain a variable tension to the riser string alleviating the potential for compression and in turn buckling or failure.

Historically, conventional riser tensioner systems have consisted of both single and dual cylinder assemblies with a fixed cable sheave at one end of the cylinder and a movable cable sheave attached to the rod end of the cylinder. The assembly is then mounted in a position on the vessel to allow convenient routing of wire rope which is connected to a point at the fixed end and strung over the movable sheaves. In turn, the wire rope is routed via additional sheaves and connected to the slip-joint assembly via a support ring consisting of pad eyes which accept the end termination of the wire rope assembly. A hydro/pneumatic system consisting of high pressure air over hydraulic fluid applied to the cylinder forces the rod and in turn the rod end sheave to stroke out thereby tensioning the wire rope and in turn the riser.

The number of tensioner units employed is based on the tension necessary to maintain support of the riser and a percentage of overpull which is dictated by met-ocean conditions i.e., current and operational parameters including variable mud weight, etc.

Available space for installation and, the structure necessary to support the units including weight and loads imposed, particularly in deep water applications where the tension necessary requires additional tensioners poses difficult problems for system configurations for both new vessel designs and upgrading existing vessel designs.

Recent deepwater development commitments have created a need for new generation drilling vessels and production facilities requiring a plethora of new technologies and systems to operate effectively in deep water and alien/harsh environments. These new technologies include riser tensioner development where reduced weight and required space are important factors to the drilling contractor.

The tensioner assemblies of the present invention offer operational advantages over conventional methodologies by providing options in riser management and current well construction techniques. Applications of the basic module design are not limited to drilling risers and floating drilling vessels. The system further provides cost and operational effective solutions in well servicing/workover, intervention and production riser applications. These applications include all floating production facilities including, tension leg platform, floating production facility, and production spar variants. The system when installed provides an effective solution to tensioning requirements and operating parameters.

An integral control and data acquisition system provides operating parameters to a central processor system which provides supervisory control.

Generally, tensioner assemblies are of two types, the piston type and the ram type. With the piston type cylinder, the rod is stroked out by pressured hydraulic fluid which is stored in an external accumulator charged with high pressure air. The hydraulic fluid flows into the cylinder from an external accumulator and the pressurized hydraulic fluid acts on the piston to extend the rod. The piston has a pressure barrier seal between the piston and the inner wall of the cylinder. When the rod is retracted the hydraulic fluid is displaced by the piston and rod flowing back into the external accumulator.

Prior ram-type tensioner assemblies include a ram, which is sealed around its outer diameter to the upper gland of the cylinder. As the pressurized hydraulic fluid flows into the cylinder from the external accumulator the ram extends. When the ram retracts, the hydraulic fluid is displaced back into the external accumulator. Therefore, these prior tensioner assemblies require the hydraulic fluid volume to be displaced by the piston or ram, which then flows back into the external accumulator.

The present invention is directed to ram-type tensioner assemblies in which the hydraulic fluid accumulator is integral with the cylinder and the ram and which includes an air transfer tube disposed within the cylinder cavity and the ram cavity to provide an air over hydraulic fluid arrangement. In this arrangement, the tensioner assemblies of the present invention provide the advantage of reducing the amount of deck space required for each tensioner assembly because external hydraulic fluid accumulators are not necessary. The tensioner assemblies of the present invention also provide that the volume occupied by the wall thickness of the ram displaces the hydraulic fluid. This results in a relatively small rise and fall of the fluid level in the hollow ram, thus eliminating the necessity for an external accumulator. Additionally, the tensioner assemblies of the present invention have reduced weight and require minimal modifications to rig structure as a result of the reduced weight. Moreover, less hydraulic fluid and less high pressure air or gas are required as compared to conventional tensioners.

SUMMARY OF INVENTION

The foregoing advantages have been obtained through the present tensioner assembly having a fully extended position, a fully retracted position, and a plurality of partially extended positions therebetween, comprising: a cylinder having a cylinder first end, a cylinder second end, a cylinder outer wall surface, a cylinder inner wall surface, and a cylinder cavity, the cylinder first end having a cylinder opening, the cylinder second end having a first attachment member, and the cylinder cavity having a first portion of hydraulic fluid disposed therein; a stop tube having a stop tube first end, a stop tube second end, a stop tube outer wall surface, a stop tube inner wall surface, and a stop tube cavity, the stop tube being disposed along at least a portion of the cylinder inner wall surface such that the cylinder inner wall surface is in communication with the stop tube outer wall surface; a ram having a ram first end, a ram second end, a ram inner wall surface, a ram outer wall surface, and a ram cavity, the ram first end being sealed and including a second attachment member, the ram second end having a ram flange disposed along the ram outer wall surface and a ram opening for fluid communication between the ram cavity and the cylinder cavity, the ram cavity having a second portion of hydraulic fluid and a gas disposed therein in a gas over hydraulic fluid arrangement, the ram outer wall surface being slidably engaged with a portion of the stop tube inner wall surface and the ram flange being slidably engaged with a portion of the cylinder inner wall surface; a hydraulic fluid accumulator defined as an annular space created by the cylinder inner wall surface, the ram outer wall surface, the stop tube second end, and the ram flange; at least one hydraulic fluid return line in fluid communication with the hydraulic fluid accumulator and the cylinder cavity; and at least one gas transfer tube disposed within a portion of the cylinder cavity and within a portion of the ram cavity, the at least one gas transfer tube being in fluid communication with a gas source and the gas disposed within the ram cavity.

A further feature of the tensioner assembly is that the cylinder second end may include a gas passageway in fluid communication with the at least one gas transfer tube and the gas source. Another feature of the tensioner assembly is that the tensioner assembly cylinder second end may include a hydraulic fluid passageway in fluid communication with the cylinder cavity and the hydraulic fluid return line. An additional feature of the tensioner assembly is that the hydraulic fluid return line may include an annular manifold disposed along a portion of the cylinder outer wall and in fluid communication with the hydraulic fluid accumulator and the at least one hydraulic fluid return line. Still another feature of the tensioner assembly is that the cylinder second end may include a hydraulic fluid passageway in fluid communication with the cylinder cavity and the hydraulic fluid return line. A further feature of the tensioner assembly is that the hydraulic fluid return line may include an annular manifold disposed along a portion of the cylinder outer wall and in fluid communication with the hydraulic fluid accumulator and the at least one hydraulic fluid return line.

The foregoing advantages have been obtained through the present tensioner assembly having a fully extended position, a fully retracted position, and a plurality of partially extended positions therebetween, comprising: a cylinder having a cylinder first end, a cylinder second end, a cylinder outer wall surface, a cylinder inner wall surface, and a cylinder cavity, the cylinder first end having a cylinder opening, the cylinder second end having a first attachment member, and the cylinder cavity having a first portion of hydraulic fluid disposed therein; a stop tube having a stop tube first end, a stop tube second end, a stop tube outer wall surface, a stop tube inner wall surface, and a stop tube cavity, the stop tube being disposed along at least a portion of the cylinder inner wall surface such that the cylinder inner wall surface is in communication with the stop tube outer wall surface; a ram having a ram first end, a ram second end, a ram inner wall surface, a ram outer wall surface, and a ram cavity, the ram first end being sealed and including a second attachment member, the ram second end having an annular piston disposed along the ram outer wall surface and a ram opening for fluid communication between the ram cavity and the cylinder cavity, the annular piston having at least one port, the ram cavity having a second portion of hydraulic fluid and a gas disposed therein in a gas over hydraulic fluid arrangement, the ram outer wall surface being slidably engaged with a portion of the stop tube inner wall surface and the annular piston being slidably engaged with a portion of the cylinder inner wall surface; a hydraulic fluid accumulator defined as an annular space created by the cylinder inner wall surface, the ram outer wall surface, the stop tube second end, and the annular piston, the hydraulic fluid accumulator being in fluid communication with the cylinder cavity through the at least one port of the annular piston; and at least one gas transfer tube disposed within a portion of the cylinder cavity and within a portion of the ram cavity, the at least one gas transfer tube being in fluid communication with a gas source and the gas disposed within the ram cavity.

A further feature of the tensioner assembly is that at least one of the at least one port of the annular piston may include at least one leaf spring disposed above the at least one of the at least one port. Another feature of the tensioner assembly is that at least one of the at least one leaf spring may be curved upwardly toward the ram first end. An additional feature of the tensioner assembly is that the at least one of the at least one leaf spring may include at least one leaf spring opening. Still another feature of the tensioner assembly is that the cylinder second end may include a gas passageway in fluid communication with the at least one gas transfer tube and the gas source. A further feature of the tensioner assembly is that the hydraulic fluid accumulator may include an annular manifold disposed along a portion of the cylinder outer wall and in fluid communication with the hydraulic fluid accumulator. Another feature of the tensioner assembly is that the annular piston may include at least one pair of ports. An additional feature of the tensioner assembly is that at least one of the at least one pair of ports may include at least one leaf spring disposed above the at least one of the at least one pair of ports. Still another feature of the tensioner assembly is that at least one of the at least one leaf spring may be curved upwardly toward the ram first end. A further feature of the tensioner assembly is that at least one of the at least one leaf spring may include at least one leaf spring opening. Another feature of the tensioner assembly is that the cylinder second end may include a gas passageway in fluid communication with the at least one gas transfer tube and the gas source. An additional feature of the tensioner assembly is that the hydraulic fluid accumulator may include an annular manifold disposed along a portion of the cylinder outer wall and in fluid communication with the hydraulic fluid accumulator. Still another feature of the tensioner assembly is that each of the at least one pair of ports may include a leaf spring disposed above each of the at least one pair of ports. A further feature of the tensioner assembly is that each of the leaf springs disposed above each of the at least one pair of ports may be curved upwardly toward the ram first end. Another feature of the tensioner assembly is that each of the leaf springs may include at least one leaf spring opening disposed above each of the ports. An additional feature of the tensioner assembly is that the cylinder second end may include a gas passageway in fluid communication with the at least one gas transfer tube and the gas source. Still another feature of the tensioner assembly is that the hydraulic fluid accumulator may include an annular manifold disposed along a portion of the cylinder outer wall and in fluid communication with the hydraulic fluid accumulator.

The tensioner assemblies of the present invention have the advantages of: reducing the overall weight of the tensioner, reducing the amount of hydraulic fluid required for operation of the tensioner assembly, and reducing the amount of air or gas required for operation of the tensioner assembly.

Figure 1:
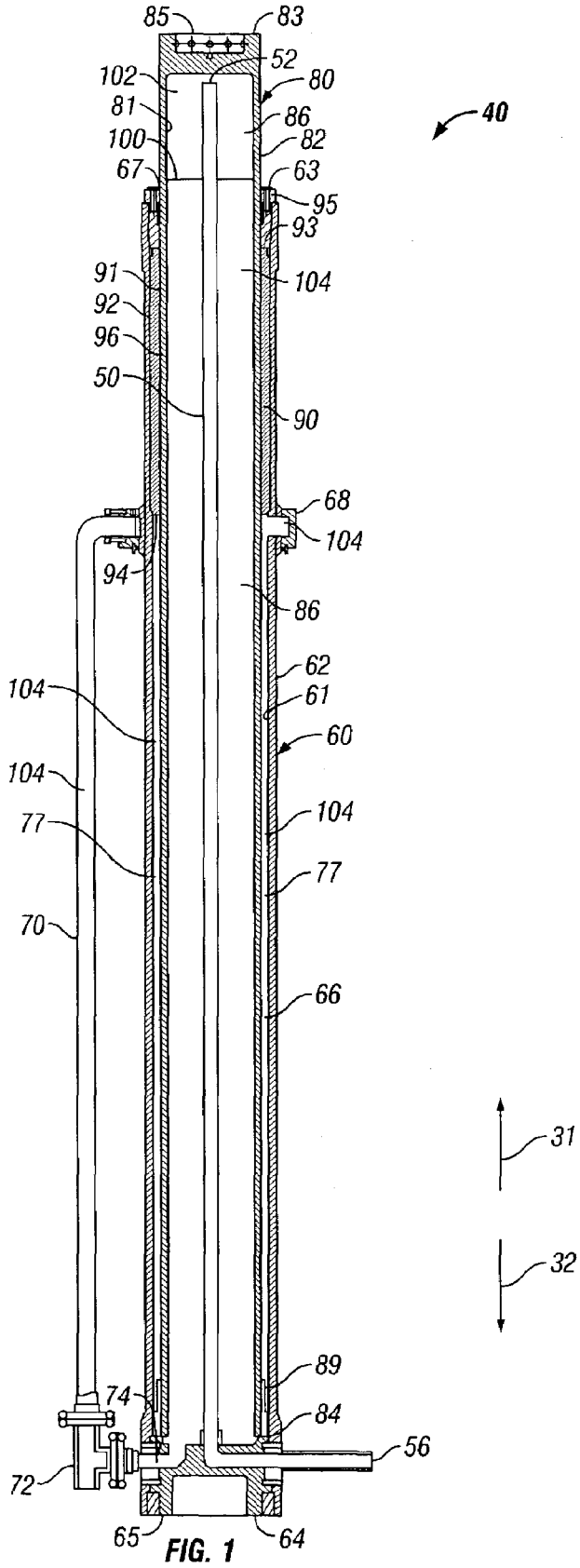
FIG. 1 is a partial cross-sectional view of one specific embodiment of the tensioner assembly of the present invention shown in the fully retracted position.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DESCRIPTION OF SPECIFIC EMBODIMENTS

The invention comprises elements that when assembled form a unitary, integral, tensioner assembly. The tensioner assemblies of the present invention may be used to replace both conventional and direct acting tensioning systems. Further, variations of the tensioner assembly may be utilized in both drilling and production riser applications.

As mentioned above, the tensioner assemblies of the present invention integrate the hydraulic fluid accumulator into the cylinder. The hydraulic fluid is stored inside the ram cavity and is pressurized with high-pressure air via an air transfer tube disposed within the cylinder cavity and the ram cavity. The high pressured air flows into an air space which is maintained at the upper end of the interior of the ram, i.e., within the ram cavity. This arrangement provides an air over oil operation.

The air pressure acts on the internal surface of one end of the ram, sometimes referred to as the ram head, combined with the pressurized hydraulic fluid acting on the surface area of the lower end of the ram to provide the force necessary to extend the ram. The ram extends with a force relative to the air pressure, however with the lower end of the ram submerged in the hydraulic fluid, hydraulic dampening is maintained to prevent excessive ram speeds, i.e., the rate at which the ram is extended from within the cylinder cavity or retracted into the cylinder cavity. Therefore, the ram speed is controlled to prevent damage to the tensioner assembly.

In one specific embodiment, an annular piston, which acts as a speed control valve, is located at the lower end of the ram and may be utilized to prevent damage caused by excessive ram speed in the event of a severed line or other situation where the load on the tensioner assembly is suddenly absent from the tensioner assembly. The annular piston includes a number of a transfer ports, or ports, located within the annular piston at the lower end of the ram. At the upper side of the ports, small leaf springs are situated over the opening of the port. These springs are curved upward so that the entrances of the ports are open for hydraulic fluid to flow through the ports. If the load on the tensioner assembly is suddenly absent, the pressure acting on the ram will cause it to accelerate toward the fully extended position at an excessive rate. As hydraulic fluid flow passing the leaf spring and entering the port exceeds a certain flow rate, a pressure imbalance is induced across the leaf spring. When this imbalance exceeds the spring rate of the leaf spring, the leaf spring is pushed closed over the entrance to the port, thereby restricting the flow rate of the hydraulic fluid through the ports, and in turn, limiting the speed of the ram. Each leaf spring preferably has an orifice, or opening, that permits a portion of hydraulic fluid to pass through the port such that the pressure imbalance will be allowed to equalize at a controlled rate instead of "freezing" in place, i.e., no longer moving. Once the pressure has equalized the leaf springs will return to their upwardly curved position for continued operation.

Figure 2:
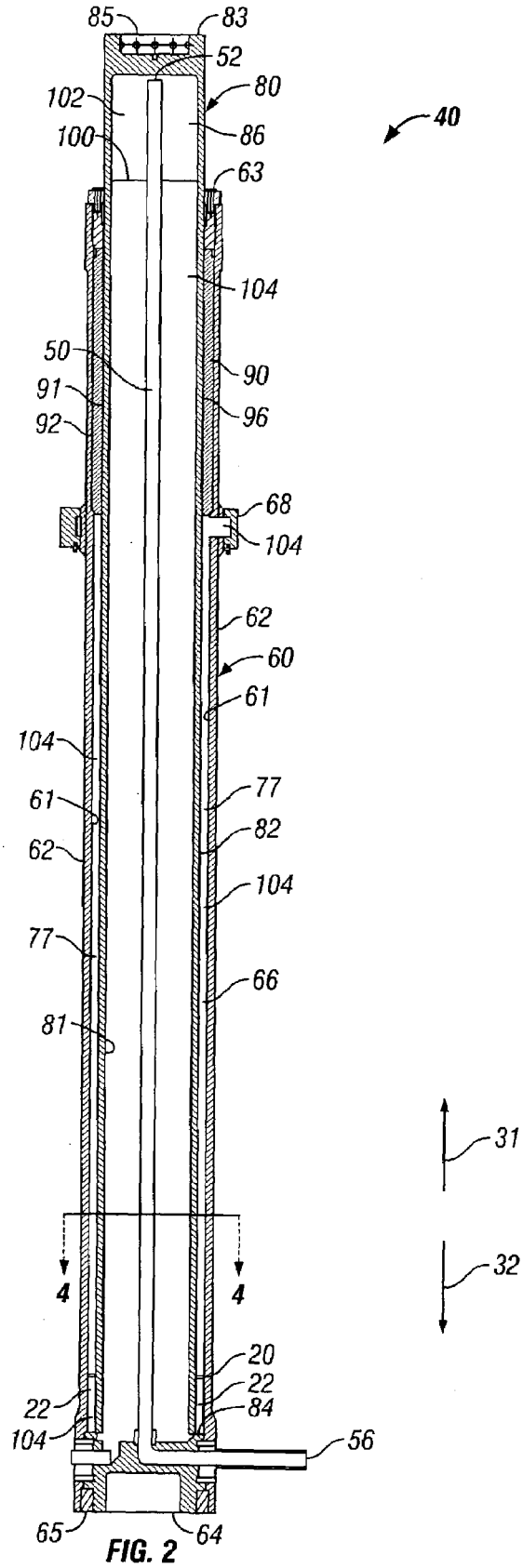
FIG. 2 is a partial cross-sectional view of another specific embodiment of the tensioner assembly of the present invention shown in the fully retracted position.
Figure 3:
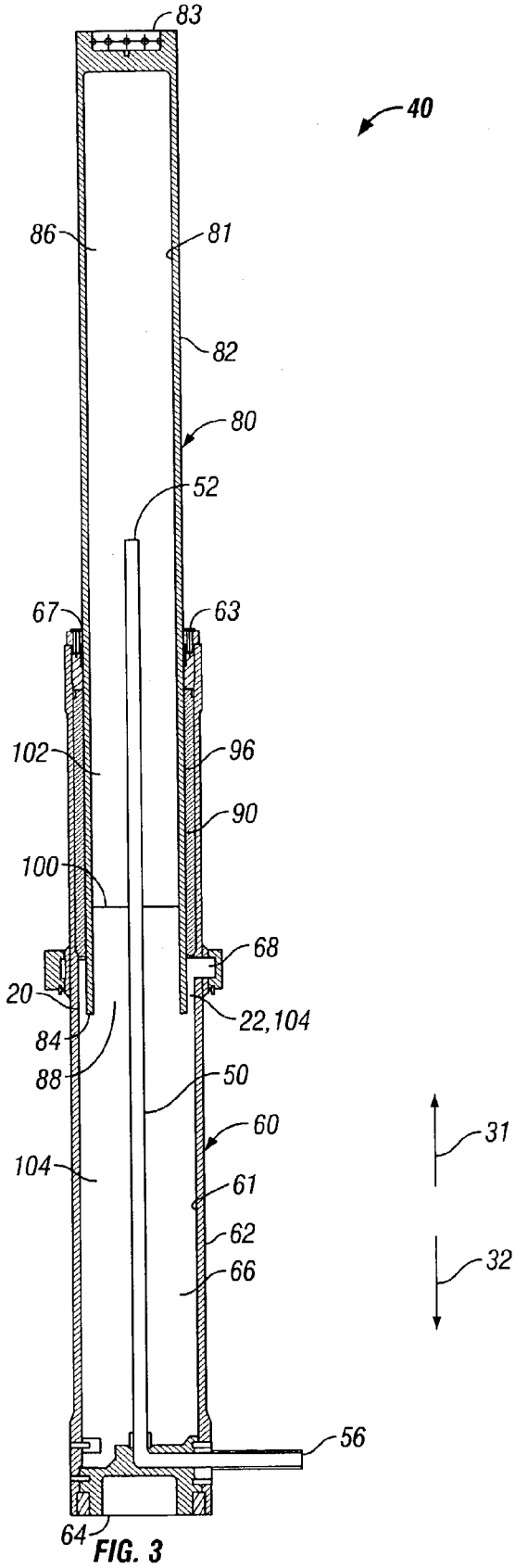
FIG. 3 is a partial cross-sectional view of the tensioner assembly shown in FIG. 2 shown in the fully extended position.

Referring now to FIGS. 1–3, broadly, the present invention is directed to tensioner assembly 40 having cylinder 60, ram 80, stop tube 90, and air transfer tube 50. Tensioner assembly 40 includes a fully retracted position (FIGS. 1 and 2), a fully extended position (FIG. 3), and a plurality of partially extended positions defined therebetween. Cylinder 60 includes cylinder inner wall surface 61, cylinder outer wall surface 62, cylinder first end 63, and cylinder second end 64. Cylinder second end 64 includes attachment member 65 to facilitate securing cylinder second end 64, and thus, tensioner assembly 40, to a riser string, a drilling vessel, or other equipment or devices that are secured to the riser string. Attachment member 65 may be any device, e.g., bolts, flanges, etc., known to persons of ordinary skill in the art.

Cylinder cavity 66 is disposed within cylinder 60 and defined by cylinder inner wall surface 61. Cylinder first end 63 includes opening 67 to permit ram 80 to move into and out of cylinder cavity 66 as discussed in greater detail below. Cylinder 60 also preferably includes annular manifold 68 to permit hydraulic fluid to be circulated around ram 80 and into hydraulic fluid accumulator 77 discussed in greater detail below.

Ram 80 includes ram inner wall surface 81, ram outer wall surface 82, ram first end, or ram head, 83, and ram second end 84. Ram first end 83 includes attachment member 85 to facilitate securing ram first end 83, and thus, tensioner assembly 40, to a riser string, a drilling vessel, or other equipment or devices that are secured to the riser string. Attachment member 85 maybe any device, e.g., bolts, flanges, etc., known to persons of ordinary skill in the art.

Ram cavity 86 is disposed within ram 80 and defined by ram inner wall surface 81. Ram second end 84 includes ram opening 88 (FIG. 3) to permit hydraulic fluid to pass into and from ram cavity 86 as discussed in greater detail below.

Stop tube 90 includes stop tube inner wall surface 91, stop tube outer wall surface 92, stop tube first end 93, stop tube second end 94, and stop tube cavity 96 disposed within stop tube 90 and defined by stop tube inner wall surface 91.

In one specific embodiment, ram 80 preferably includes ram flange 89 (FIG. 1) disposed along a portion of ram outer wall surface 82, preferably near ram second end 84. Ram flange 89 contacts stop tube 90 when tensioner assembly 40 is in the fully extended position (FIG. 3). As such, ram flange 80 facilitates maintaining ram 80 within cylinder cavity 66 and stop tube cavity 96.

Tensioner assembly 40 is assembled by inserting ram 80 into cylinder cavity 66 by placing ram second end 84 through cylinder opening 67 such that air transfer tube 50 is disposed within ram cavity 86. Ram 80 is inserted into cylinder cavity 66 until ram second end 84 contacts cylinder second end 64, i.e., tensioner assembly 40 is in the fully retracted position (FIGS. 1 and 2). Ram flange 89, or annular piston 20 (discussed in greater detail below), are slidably engaged with cylinder inner wall surface 61, and hydraulic fluid accumulator 77 is formed between cylinder inner wall surface 61 and ram outer wall surface 82. Ram flange 89, or annular piston 20, is slidably engaged with cylinder inner wall surface 61 such that no hydraulic fluid or air is permitted to pass between ram flange 89, or annular piston 20, and cylinder inner wall surface 61.

Stop tube 90 is then disposed around ram 80 (i.e., ram 80 is inserted into stop tube cavity 96) and stop tube 90 is inserted into cylinder cavity 66 such that stop tube outer wall surface 92 is in communication with cylinder inner wall surface 61 and stop tube inner wall surface 91 is slidably engaged with ram outer wall surface 82. Stop tube 90 is preferably secured to cylinder inner wall surface 61 such that stop tube is incapable of movement and no hydraulic fluid or air is permitted to pass between cylinder inner wall surface 61 and stop tube outer wall surface 92. As shown in FIGS. 1–3, stop tube 90 is secured in place by flange and bolt assembly 95. Stop tube inner wall surface 91 is slidably engaged with ram outer wall surface 82 such that no hydraulic fluid or air is permitted to pass between stop tube inner wall surface 91 and ram outer wall surface 82.

In this arrangement, ram flange 89, or annular piston 20, is permitted to slide along cylinder inner wall surface 61 until contacting stop tube 90. At the point where ram flange 89 or annular piston 20 contacts stop tube 90, tensioner assembly 40 is in the fully extended position (FIG. 3).

Disposed within cylinder cavity 66 and at least a portion of ram cavity 86 is gas, or air, transfer tube 50. While the tensioner assembly is discussed herein as having a "air," it is to be understood that any gas may be used, e.g., atmospheric air or nitrogen. Air transfer tube 50 is in fluid communication with an air source (not shown), such as one or more air pressure vessels, that provides pressurized air into ram cavity 86 and cylinder cavity 66 to provide tensile force to tensioner assembly 40. Air transfer tube 50 includes air transfer tube opening 52. Preferably, cylinder second end 64 includes air passageway 54 to facilitate the transportation of air from the air source to air transfer tube 50.

When tensioner assembly 40 is in the fully retracted position (FIGS. 1 and 2), hydraulic fluid accumulator 77 is formed by ram outer wall surface 82 and cylinder inner wall surface 61 as an annular ring around ram 80. As tensioner assembly 40 is moved from the fully retracted position (FIGS. 1 and 2) to the fully extended position (FIG. 3), hydraulic fluid accumulator 77 and cylinder cavity 66 become in fluid communication with each other and the volume of the annular space forming hydraulic fluid accumulator 77 is reduced.

In one specific embodiment shown in FIG. 1, tensioner assembly 40 includes a hydraulic fluid return line 70 in fluid communication with annular manifold 68 and cylinder cavity 66 and thus ram cavity 86. Preferably, cylinder second end 64 includes hydraulic fluid passageway 74 to facilitate the transportation of hydraulic fluid from ram cavity 86 and cylinder cavity 66 to hydraulic fluid return line 70. Hydraulic fluid return line 70 preferably includes control valve 72 such as a Riser Inertia Management and Control® (RIMAC®) system to facilitate regulation of the flow of hydraulic fluid through hydraulic fluid return line 70 and to control the riser pipe in the event of an unexpected separation of ram 80 from cylinder 60. Therefore, the tensile force created by tensioner assembly 40 can be controlled such that the speed at which ram 80 moves within cylinder 70 and stop tube 90 does not exceed a set speed at which ram 80 maybe forced from its slidable engagement with stop tube 90 or otherwise cause damage to tensioner assembly 40.

Figure 4:
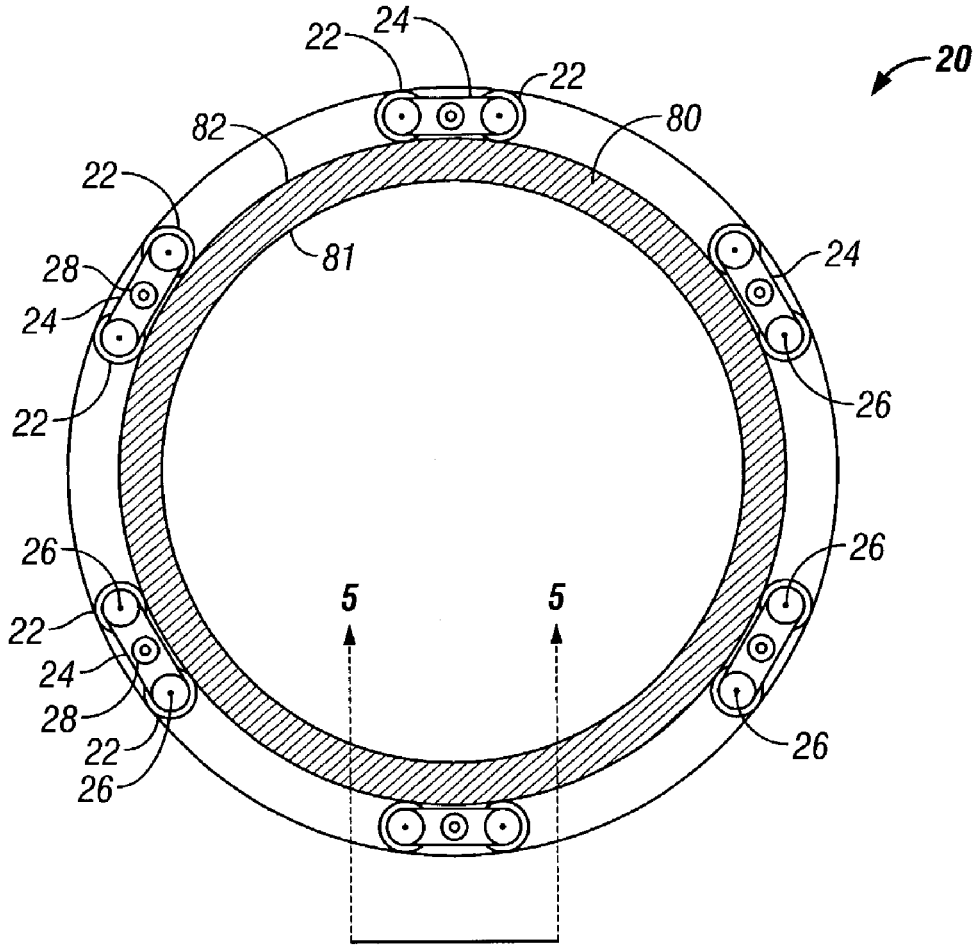
FIG. 4 is a cross-sectional view of the tensioner assembly shown in FIG. 2 taken along line 4—4.
Figure 5:
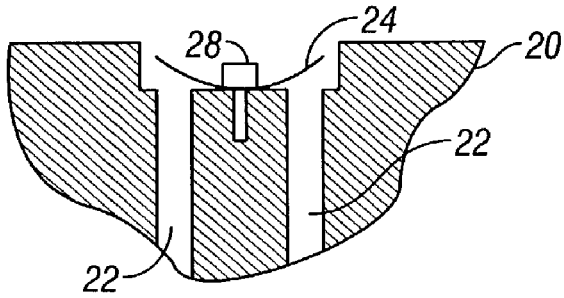
FIG. 5 is cross-sectional view the annular piston shown in FIG. 4 taken along line 5—5.

Referring now to FIGS. 2–5, in one specific embodiment, annular piston 20 performs the function of ram flange 89. Like ram flange 89, annular piston 20 is disposed along ram outer wall surface 82 near ram second end 84. Unlike ram flange 89, however, which only provides the function of stopping further extension of ram 80, annular piston 20 controls the speed at which ram 80 moves within cylinder 70 and stop tube 90. As illustrated in FIGS. 4 and 5, annular piston 20 preferably includes a plurality of ports 22 through which hydraulic fluid is permitted to pass from hydraulic fluid accumulator 77 into cylinder cavity 66, and vice versa. Port 22 includes leaf spring 24 disposed over port 22 to facilitate controlling the flow of hydraulic fluid through port 22. Leaf spring 24 preferably includes at least one leaf spring orifice or opening 26 through which hydraulic fluid is permitted to pass.

As shown in FIGS. 4 and 5, preferably, ports 22 are arranged in pairs with each pair of ports 22 having leaf spring 24 disposed above the pair of ports 22 with leaf spring orifice or opening 26 disposed above each port 22. Leaf spring 26 is curved upwardly, i.e., in the direction of first end 83, such that the flow of hydraulic fluid through port 22 in the direction of arrow 31 is buffered, or slowed, and such that the flow of hydraulic fluid through port 22 in the direction of arrow 32 is likewise buffered, or slowed. In situations in which ram 80 is being forced out of cylinder 60, i.e., in the direction of arrow 31 toward the fully extended position, at a high rate of speed, leaf spring 26 is flattened out to cover a portion of port 22, thereby restricting the flow of hydraulic fluid through port 22, and thus slowing the extension of ram 80 out of cylinder 60. Fastener devices, e.g., bolts 28, may be used to secure leaf spring 26 to annular piston 20.

While annular piston 22 is described as having a plurality of ports 22, with a plurality of leaf springs 26, it is to be understood that annular piston 22 may only have one port, with, or without, a leaf spring 26, and leaf spring 26 may or may not be include leaf spring opening 26.

As shown in FIGS. 1 and 2, once assembled, cylinder cavity 66, ram cavity 86, and hydraulic fluid accumulator 77 may be filled with hydraulic fluid in the spaces represented by the reference numeral 104. Ram cavity 86 may then be partially filled with air in the space represented by the reference numeral 102 from a air source and passing through air transfer tube 50, thereby establishing a hydraulic fluid level 100 in a gas over hydraulic fluid arrangement. The pressures of the air and hydraulic fluid do not move ram 80 when the pressures are at equilibrium.

As tensioner assembly 40 is moved from the fully retracted position (FIGS. 1 and 2) to one or more of the partially extended positions or the fully extended position (FIG. 3), the air in space 102 is pressurized by additional air being transported from the air source, through air passageway 54, through air transfer tube 50, out of air tube opening 52, and into space 102 of ram cavity 86. In so doing, the pressurized air in space 102 forces ram head 83 to move in the direction of arrow 31. Additionally, the pressurized air forces hydraulic fluid level 100 to be moved downward, in the direction of arrow 32. The pressurized hydraulic fluid in spaces 104 is compressed and facilitates exertion of an upward force, i.e., in the direction of arrow 31, to force ram head 83 to move in the direction of 31 until tensioner assembly reaches the fully extended position (FIG. 3), or until the pressure of the air and the pressure of the hydraulic fluid reach equilibrium.

Additionally, with respect to the specific embodiment of tensioner assembly 40 shown in FIGS. 2–5, as ram 80 is moved in the direction of arrow 31, hydraulic fluid is transported from hydraulic fluid accumulator 77 through annular piston 20 in the direction of arrow 32, by passing through ports 22, and into cylinder cavity 66. In so doing, the volume of hydraulic fluid accumulator 77 is reduced.

Conversely, when ram 80 is moved in the direction of arrow 32, hydraulic fluid is transported from cylinder cavity 66, through annular piston 20 in the direction of arrow 31, by passing through ports 22, and into hydraulic fluid accumulator 77. In so doing, the volume of hydraulic fluid accumulator is increased.

With respect to the specific embodiment of tensioner assembly 40 shown in FIG. 1, as air is transported from the air source into ram cavity 86, and thus ram 80 is moved in the direction of arrow 31, hydraulic fluid is transported from hydraulic fluid accumulator 77, through annular manifold 68, into hydraulic fluid return line 70, through hydraulic fluid return line 70, through control valve 72, through hydraulic fluid passageway 74, and into cylinder cavity 66.

Conversely, as the air pressure is lessened, and transported out of space 102 of ram cavity 86, ram is moved in the direction of arrow 32. In so doing, hydraulic fluid is transported from cylinder cavity 66, through hydraulic fluid passageway 74, through control valve 72, through hydraulic fluid return line 70, into annular manifold 68, and into hydraulic fluid accumulator 77.

As will be apparent to persons of ordinary skill in the art, hydraulic fluid level 100 is preferably always lower, i.e., closer to cylinder second end 64, than air transfer tube opening 52. Therefore, hydraulic fluid 104 will not be permitted to pass into air transfer tube 50.

While it is to be understood that cylinder 60, ram 80, and stop tube 90 may be formed out of any material known to persons of ordinary skill in the art, preferably, cylinder 60, ram 80, and stop tube 90 are manufactured from a light weight material that helps to reduce the overall weight of tensioner assembly 40, helps to eliminate friction and metal contact within cylinder 60 and stop tube 90, and helps reduce the potential for electrolysis and galvanic action causing corrosion. Examples include, but are not limited to, carbon steel, stainless steel, aluminum and titanium.

Tensioner assembly 40 may be connected directly to the riser string or indirectly to the riser string by connecting tensioner assembly 40 to a riser ring or other device which facilitates connecting tensioner assembly 40 to the riser string.

Tensioner assembly 40 of the present invention may be utilized to compensate for offset of an oil drilling vessel connected to a riser or blowout preventer stack. For example, the tensioner assembly is placed, or disposed, in communication with an oil drilling vessel and the riser or blowout preventer stack rising through the ocean from the wellbore.

Additionally, the oil drilling vessel may be stabilized using the tensioner assembly of the present invention by maintaining and adjusting tension in the cylinder by maintaining and adjusting the pressure in the cylinder and the ram by placing the ram or air transfer tube and air source in communication with at least one control source.

It is to be understood that the invention is not limited to the exact details of construction, operation, exact materials, or embodiments shown and described, as obvious modifications and equivalents will be apparent to one skilled in the art. For example, the annular piston may include only one port. Further, each port in the annular piston does not require a leaf spring, thereby permitting each port in the annular piston to be modified to restrict the flow of hydraulic fluid. Also, the tensioner assembly may be assembled using bolts, welding, or any other device or method known to persons of ordinary skill in the art. Additionally, the stop tube may be a flange or ledge formed integral with the cylinder inner wall surface and disposed within the cylinder cavity. Moreover, the individual components may be manufactured out of any material and through any method known to persons of ordinary skill in the art. Accordingly, the invention is therefore to be limited only by the scope of the claims.

What is claimed is:

1. A tensioner assembly having a fully extended position, a fully retracted position, and a plurality of partially extended positions therebetween, comprising:

a cylinder having a cylinder first end, a cylinder second end, a cylinder outer wall surface, a cylinder inner wall surface, and a cylinder cavity, the cylinder first end having a cylinder opening, the cylinder second end having a first attachment member, and the cylinder cavity having hydraulic fluid disposed therein;

a stop tube having a stop tube first end, a stop tube second end, a stop tube outer wall surface, a stop tube inner wall surface, and a stop tube cavity, the stop tube being disposed along at least a portion of the cylinder inner wall surface such that the cylinder inner wall surface is in communication with the stop tube outer wall surface;

a ram having a ram first end, a ram second end, a ram inner wall surface, a ram outer wall surface, and a ram cavity, the ram first end being sealed and including a second attachment member, the ram second end having a ram flange disposed along the ram outer wall surface and a ram opening for fluid communication between the ram cavity and the cylinder cavity, the ram cavity having a gas disposed therein in a gas over hydraulic fluid arrangement, the ram outer wall surface being slidably engaged with a portion of the stop tube inner wall surface and the ram flange being slidably engaged with a portion of the cylinder inner wall surface;

a hydraulic fluid accumulator defined as an annular space created by the cylinder inner wall surface, the ram outer wall surface, the stop tube second end, and the ram flange;

at least one hydraulic fluid return line in fluid communication with the hydraulic fluid accumulator and the cylinder cavity; and at least one gas transfer tube disposed within a portion of the cylinder cavity and within a portion of the ram cavity, the at least one gas transfer tube being in fluid communication with a gas source and the gas disposed within the ram cavity.

2. The tensioner assembly of claim 1, wherein the cylinder second end includes a gas passageway in fluid communication with the at least one gas transfer tube and the gas source.

3. The tensioner assembly of claim 2, wherein the cylinder second end includes a hydraulic fluid passageway in fluid communication with the cylinder cavity and the hydraulic fluid return line.

4. The tensioner assembly of claim 3, wherein the hydraulic fluid return line includes an annular manifold disposed along a portion of the cylinder outer wall and in fluid communication with the hydraulic fluid accumulator and the at least one hydraulic fluid return line.

5. The tensioner assembly of claim 1, wherein the cylinder second end includes a hydraulic fluid passageway in fluid communication with the cylinder cavity and the hydraulic fluid return line.

6. The tensioner assembly of claim 5, wherein the hydraulic fluid return line includes an annular manifold disposed along a portion of the cylinder outer wall and in fluid communication with the hydraulic fluid accumulator and the at least one hydraulic fluid return line.

* * * * *